United States Patent [19]

Ecklund et al.

[11] 4,368,356

[45] Jan. 11, 1983

[54] PILOT TONE DETECTOR UTILIZING PHASE DEVIATION SIGNALS

[75] Inventors: Lawrence M. Ecklund, Wheaton; Frank Drong, Jr., Chicago, both of Ill.

[73] Assignee: Motorola Inc., Schaumburg, Ill.

[21] Appl. No.: 245,800

[22] Filed: Mar. 20, 1981

[51] Int. Cl.[3] ..... H04H 5/00

[52] U.S. Cl. ..... 179/1 GS; 179/1 GN

[58] Field of Search ..... 179/1 GN, 1 GS, 1 GC

[56] References Cited

U.S. PATENT DOCUMENTS

| | | | |
|---|---|---|---|
| 3,944,749 | 3/1976 | Kahn | 179/1 GS |
| 4,159,396 | 6/1979 | Hilbert et al. | 179/1 GS |
| 4,164,623 | 8/1979 | Hilbert et al. | 179/1 GS |
| 4,249,039 | 2/1981 | Fisher et al. | 179/1 GS |
| 4,255,751 | 9/1980 | Hershberger | 179/1 GS |

*Primary Examiner*—R. J. Hickey

*Attorney, Agent, or Firm*—James W. Gillman; James S. Pristelski; Margaret Marsh Parker

[57] ABSTRACT

An AM stereophonic pilot tone is detected using two signals derived from a received broadcast signal. One signal is proportional to the phase deviation and one is a two-level signal which is a function of the magnitude of the phase deviation. The detector controls activation of the visual indicator, muting of the stereo channel of mono/stereo mode switching with almost complete elimination of false detections during monophonic transmission and poor stereo transmission.

6 Claims, 4 Drawing Figures

PILOT TONE DETECTOR UTILIZING PHASE DEVIATION SIGNALS

BACKGROUND OF THE INVENTION

This invention relates to the detection of an AM Stereo Pilot Tone and, more particularly, to such detection based on certain given decoded signals.

Along with the development of the various possible ways of transmitting compatible stereophonic information within the AM broadcast band, has come the recognition that it is a practical, if not technical, necessity to provide an additional piece of information. This information is used, as is the case in the FM stereo, to quickly indicate that a stereo signal is being received. The information is usually termed a "pilot tone".

Typically, a visual indicator will be activated to let the user of the receiver know that it is tuned to a stereo broadcast. Also, circuitry within the receiver may be activated or switched in response to the presence or absence of the pilot tone signal since it is usually preferable to operate in the monophonic mode unless a satisfactory stereo signal is present. If a poor signal is present, or there is a considerable amount of noise present, many pilot tone detectors will "false" frequently, which has been found very annoying to the user, both visually and aurally. Such falsing is most often observed under the conditions of over-modulation of the transmitted signal, of incidental phase modulation due to poorly aligned transmitters, and during tuning.

Many circuits have been developed to detect the pilot tones of the various known AM stereo signals, and attempts have been made to provide, in one IC, a universal stereo decoder and pilot tone detector. Since the presently known signals and their associated pilot tones vary considerably, this latter goal has proven difficult if not impossible to achieve. In one such attempt, an IC was developed which could decode, with various external circuit modifications, perhaps as many as three different signals. This chip, however, did not include in its internal circuitry the capability of detecting the pilot tone. This was done externally in the case of one particular stereo signal only. It is the manufacturer's position that the chip cannot be used to detect other pilot tones satisfactorily.

SUMMARY OF THE INVENTION

It is an object, therefore, of the present invention to utilize certain predetermined signals for the detection of the pilot tone of a particular AM stereo signal.

It is a particular object to provide such detection with essentially no false detect signals.

It is an additional object to provide this detection while using a minumum number of parts. These objects and others which will become apparent are achieved in a detector having three signal inputs which may be provided by a single integrated circuit AM stereo decoder chip. A first input signal will be an audio signal which is proportional to the phase deviation of the received stereophonic signal. This input signal will be filtered to remove all signals at other than the pilot tone frequency. The second input signal will be a function of the magnitude of the phase deviation of the received signal, and will preferably have two levels to indicate normal deviation or an excess phase deviation. A control circuit will gate the filter output signal in response to a first control signal; then the filter output signal will be rectified and integrated and coupled to a comparator for comparison with a third input signal which will be a DC reference signal. The comparator output signal activates a visual indicator such as an LED, and can also control the operating mode of the receiver. The second input signal is also rectified and integrated and provides the first control signal for operating the control gate.

BRIEF DESCRIPTION OF THE DRAWING

FIG. 3 is a block diagram of a simplified embodiment of the detector.

DETAILED DESCRIPTION OF THE PREFERRED EMBODIMENT

Figure 1:
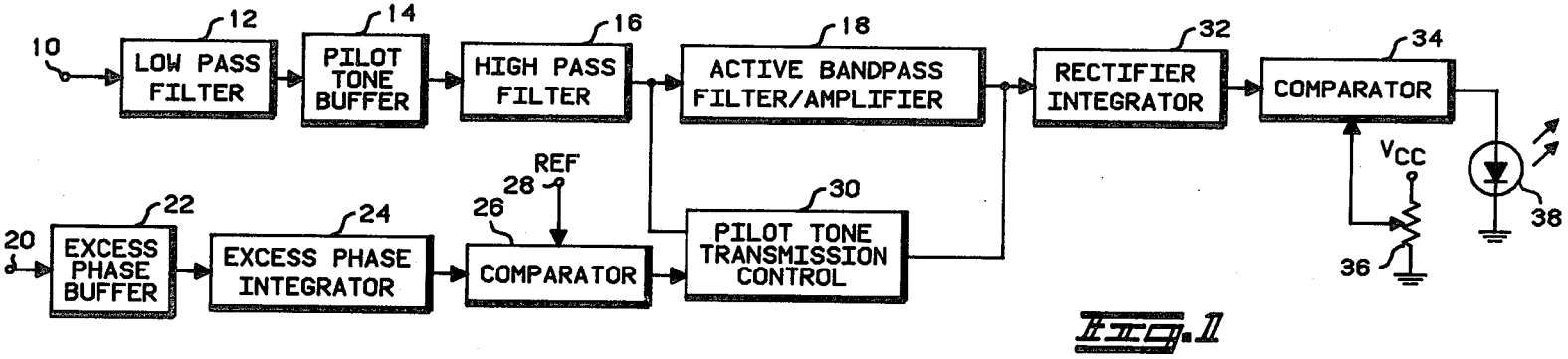
FIG. 1 is a block diagram of the detector of the invention.
Figure 7:
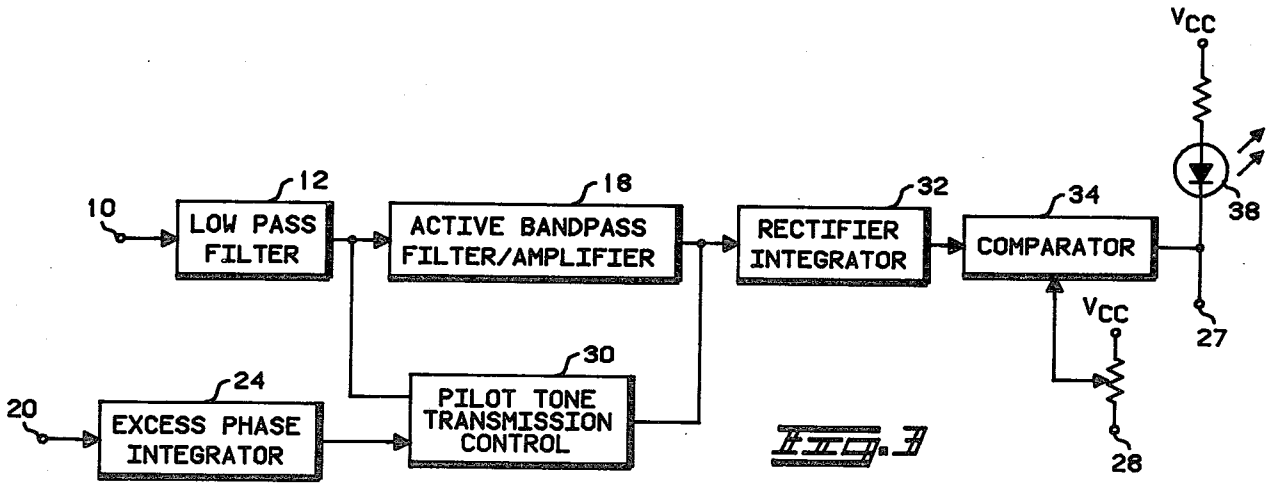

The block diagram of FIG. 1 represents a pilot tone detector which can operate from three input signals (plus the necessary power sources). Two of these three input signals are derived from a transmitted and received AM stereophonic signal, preferably a compatible quadrature signal of the form $(1+L+R)\cos(w_c t+\phi)$ where L and R are intelligent signals and $\phi$ is arc tan $[(L-R+PT)/(1+L+R)]$. PT is a single frequency pilot tone which is added to the difference channel during stereo transmission. The third input signal is merely a reference voltage, preferably at about 4.5 volts. The source of all three signals can be an integrated circuit decoder LM1981, manufactured by National Semiconductor Corp. for use in decoding a different AM Stereo signal than the one described above. In that signal, the pilot tone is a 5Hz signal which phase modulates the carrier, and has a much higher deviation than the audio signal which also phase modulates the carrier.

While detection of a pilot tone in a received signal will indicate reception of a stereo transmission, it is not necessarily desirable to switch to or remain in the stereo mode of operation during all stereo signal receptions when using the above-mentioned decoder. Such would be the case when a very noisy signal is received due to IPM, an overmodulated signal, or simply during the tuning process. To prevent this from happening, the IC has one output signal which is responsive to an excess phase deviation; i.e., the signal current is at a low level unless the phase deviation exceeds 80°. Since an excessive phase deviation is an indication of a poor quality received signal, it also indicates the desirability of using the monophonic mode of operation. The excess phase signal is filtered and coupled back to an input of the IC chip for muting the L−R signal so that only L+R is fed to the matrix.

Another output terminal of the chip will provide, using the compatible quadrature signal described above, a signal which is a function of the phase deviation $\phi$.

In FIG. 1, at an input terminal 10, the input signal is the signal which is a function of phase deviation. This signal is coupled through a low-pass filter 12, a buffer stage 14 and a high pass filter 16 to an active bandpass filter/amplifier 18. These four stages are designed so that any output of the amplifier is essentially limited to the frequency of the pilot tone. In the preferred embodiment, this will be 25 Hz.

The input signal which indicates excess phase deviation is received at an input terminal 20 and is coupled through an excess phase buffer 22, and an excess phase integrator 24 (with fast attack, slow decay characteristic) to a comparator 26. The second input signal to the comparator is from a reference source at terminal 28. This signal is the 4.5 volt reference referred to above. When the output signal of the integrator 24 goes below the reference voltage, this indicates satisfactory stereo signals are being received. The output signal from the comparator 26 is coupled through a limiting resistor 29 to activate a pilot tone transmission control circuit 30. The control circuit 30 is coupled to the filter/amplifier 18 and effectively shorts the filter/amplifier when an unsatisfactory stereo signal is being received. In this way, the circuit is prevented from "ringing" in the event of noise bursts or pops in the pilot tone signal. If the filter circuit is not shorted or damped, such extraneous signals can cause false stereo "detects". Falsing is highly undesirable since it will not only cause the indicator to go on and off intermittently, but, more importantly, will cause the receiver to constantly switch between mono and stereo modes, and will allow any extraneous signals in the L−R channel to come through the audio system.

The output of the filter/amplifier 18 is coupled to a rectifier/integrator circuit 32 which provides a positive-going signal with a fast attack, slow decay characteristic to a comparator 34. The signal on the minus input of the comparator comes from a pilot threshold control 36 which allows adjustment of the comparator 34 sensitivity. A positive-going signal greater than the signal at the minus input causes the comparator output to go high. The comparator output in this embodiment controls a stereo indicator 38, which is preferably an LED but may, of course, be any desired indicator.

Figure 2:
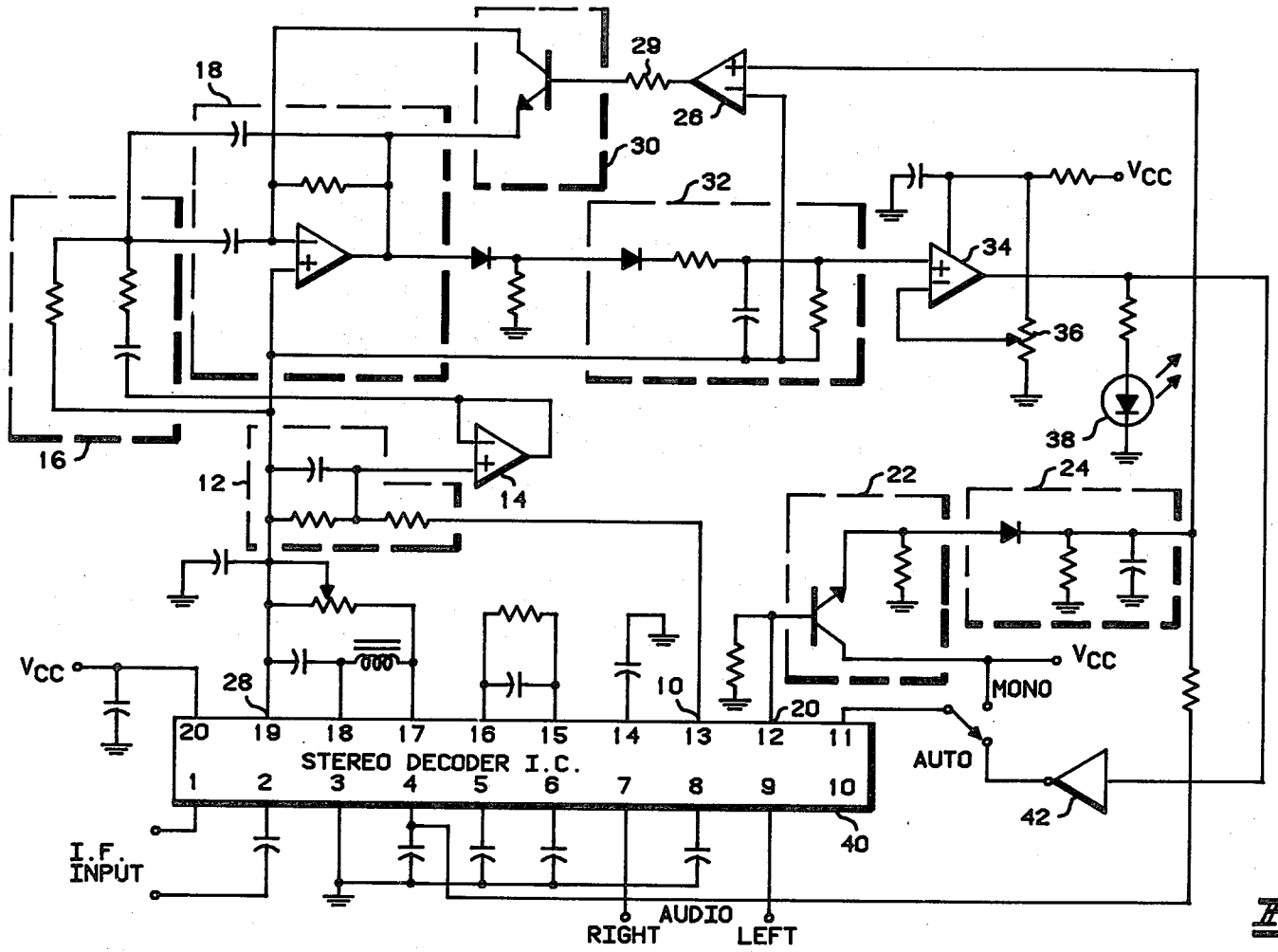
FIG. 2 is a schematic diagram of the detector of FIG. 1.

The diagram of FIG. 2 gives additional details of the pilot tone detector FIG. 1. The input terminals 10, 20 and 28 are shown as outputs of an AM stereo decoder IC 40 which was described above, by way of example, as an LM1981 chip. Pins 1 and 2 of the IC 40 are inputs to be coupled to the IF output of an AM stereo receiver. When the compatible quadrature signal as described above is received, the IF output will be $(1+L+R)\cos(w_c t+\phi)$ where w is now the IF carrier frequency. In the IC 40, this signal is limited to produce a signal varying in phase $\phi$ only which in this instance is arc tan $[(L-R+PT)/(1+L+R)]$. This signal is processed in an "excess phase detector" (not shown) in the IC 40 to provide outputs at pins 12 and 13 which are coupled to input terminals 20 and 10 respectively. The signal coming in to the terminal 20 will be essentially a two-level signal in that when $\phi$ becomes greater than the maximum phase deviation to be expected in a satisfactory signal (75°-80°), the excess phase signal, which is normally low, now goes high. The signal coming into terminal 10 was derived from the phase deviation of the AM stereo signal and thus includes any signals at the PT frequency (pilot tone=25 Hz). When this input signal is processed in the lowpass filter 12, highpass filter 16 and the active band pass filter/amplifier 18, the output of the filter/amplifier will be essentially the 25 Hz component, with one exception. If, due to an excess phase deviation causing the signal at terminal 20 to go high, the control circuit 30 will "turn off" the filter/amplifier 18, preventing any output, thus the LED 38 will not light to indicate a stereo signal. An inverting circuit 42 may be coupled to the comparator 34 output and to the "auto-blend" position of a manual mode switch 44.

FIG. 3 is a block diagram of the second embodiment of the pilot tone detector which performs an additional function and uses fewer parts with completely satisfactory performance. Here the high pass filter 16 has been omitted, thus the pilot tone buffer 14 is no longer needed for isolation and impedance matching. In the control path from terminal 20, excess phase buffer 22 and comparator 26 have been eliminated. A signal may be taken off, as from a terminal 27, for controlling the mode of operation of the receiver. Other differences between the two embodiments may be seen in FIG. 4.

Figure 4:
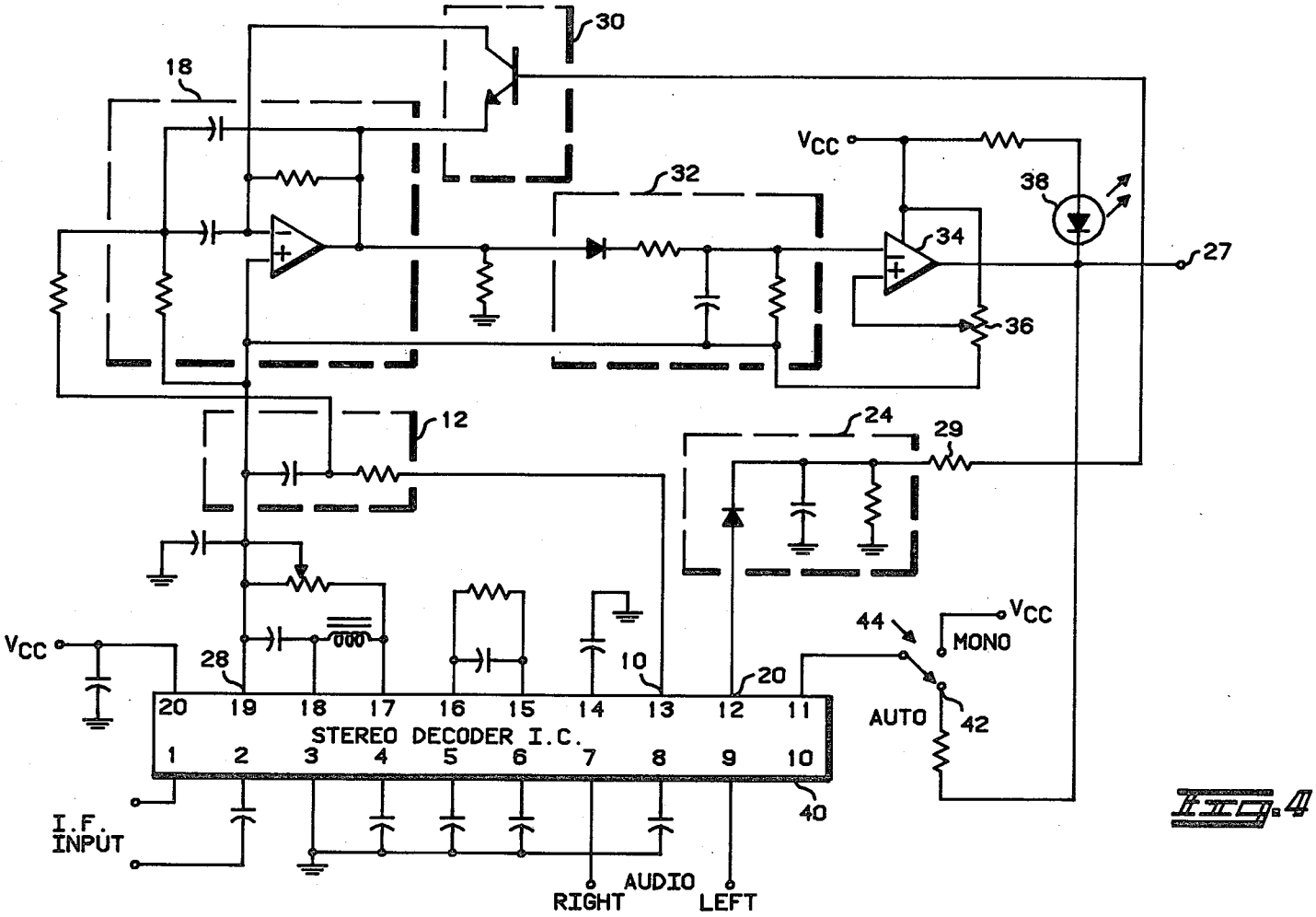
FIG. 4 is a schematic diagram of the embodiment of FIG. 3.

FIG. 4 is a schematic diagram for this simplified version. It may be seen that the excess phase signal at the input terminal 20 is now rectified and integrated as before but without the buffering step. It is then coupled through the limiting resistor 29 to the gate 30. The pilot threshold control 36 is here coupled between VCC, and the reference voltage on terminal 28 (pin 19 of IC 40) and the comparator inputs are reversed. The value of a resistor 41 is adjusted to provide the desired amount of hysteresis for the control operation. The LED 38 has been coupled between Vcc and the comparator 34 output, and the comparator output is coupled directly to the auto-blend position of the manual mode switch 44. The switch 44 is coupled to pin 11 of the IC 40. If the signal on pin 11 is greater than the reference voltage on pin 19, the L−R signal is blocked, and the audio output at each of the pins 7 and 9 of the IC 40 will be L+R, the monophonic signal. With the switch 44 in the mono position, the signal on pin 11 will be continuously at a high level.

In the embodiment of FIG. 4, a modification may be necessary if the voltage supply Vcc is not sufficiently stable. This would entail reversing the diode in the integrator 32 and coupling the pilot threshold control 36 between pin 19 of the IC 40 and ground. The connections to the comparator 34 would also be reversed. This puts a regulated voltage on the control 36.

Thus, there has been shown and described a pilot tone detector for an AM stereo receiver which will activate an indicator and mute the stereo channel when the stereo signals are not present or are of poor quality, and will essentially eliminate false stereo indications under poor signal conditions. Other variations and modifications are possible and it is intended to cover all such as fall within the spirit and scope of the appended claims.

What is claimed is:

1. A pilot tone detector for detecting a predetermined frequency when present in a received AM stereophonic signal and comprising:

a first input means for providing an audio input signal which is proportional to the phase deviation $\phi$ of the received signal;

a second input means for providing a second input signal which is a function of the magnitude of the phase deviation of the received signal;

filter means coupled to the first input means for providing an output signal essentially limited to the predetermined received frequency;

first circuit means coupled to control the output of the filter means in response to a first control signal;

second circuit means coupled to receive the controlled output signal of the filter means for rectifying and integrating said output signal and providing a second controlled output signal in response thereto;

a reference voltage source;

comparator means coupled to receive the second controlled signal and the reference voltage for providing a third controlled signal in response thereto;

an indicator means coupled to the comparator means for being controlled by the third controlled signal; and third circuit means coupled to the second input means for processing the second input signal for providing the first control signal to the first circuit means.

2. A pilot tone detector in accordance with claim 1, wherein the second input signal is a two-level signal which changes level at a predetermined value of phase deviation.

3. A pilot tone detector in accordance with claim 1, wherein the filter means includes an active filter/amplifier and further wherein the gain of the amplifier is controlled by the first control signal.

4. A pilot tone detector in accordance with claim 1, wherein the indicator means is a visual indicator.

5. A pilot tone detector in accordance with claim 1, wherein the third circuit means includes means for shaping the second input signal to provide a first control signal having a fast attack/slow decay characteristic.

6. A pilot tone detector for detecting a predetermined frequency PT when present in a received AM stereophonic signal of the form $(1+L+R)\cos(w_c t+\phi)$ where L and R are intelligence signals, $w_c t$ is the carrier, and $\phi$ is arc tan $[(L+R+PT)/(1+L+R)]$ and PT is a single frequency stereo presence signal, and comprising:

a first input means for providing a audio input signal which is proportional to the phase deviation $\phi$ of the received signal;

a second input means for providing a second input signal which is a function of the magnitude of the phase deviation of the received signal;

filter means coupled to the first input means for providing an output signal essentially limited to the predetermined received frequency;

first circuit means coupled to control the output of the filter means in response to a first control signal;

second circuit means coupled to receive the controlled output signal of the filter means for rectifying and integrating said output signal and providing a second controlled output signal in response thereto;

a reference voltage source;

comparator means coupled to receive the second controlled signal and the reference voltage for providing a third controlled signal in response thereto;

an indicator means coupled to the comparator means for being controlled by the third controlled signal; and third circuit means coupled to the second input means for processing the second input signal for providing the first control signal to the first circuit means.

* * * * *